US009354554B2

(12) United States Patent
Sadamitsu et al.

(10) Patent No.: US 9,354,554 B2
(45) Date of Patent: May 31, 2016

(54) IMAGE FORMING APPARATUS HAVING TONER COLLECTION

(71) Applicant: CANON KABUSHIKI KAISHA, Tokyo (JP)

(72) Inventors: Yushi Sadamitsu, Kashiwa (JP); Yutaka Koga, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/522,995

(22) Filed: Oct. 24, 2014

(65) Prior Publication Data

US 2015/0139712 A1 May 21, 2015

(30) Foreign Application Priority Data

Oct. 24, 2013 (JP) ..... 2013-220922

(51) Int. Cl.
*G03G 21/10* (2006.01)
*G03G 15/08* (2006.01)
*G03G 21/12* (2006.01)

(52) U.S. Cl.
CPC ..... *G03G 15/0886* (2013.01); *G03G 21/105* (2013.01); *G03G 21/12* (2013.01)

(58) Field of Classification Search
CPC ..... G03G 21/10; G03G 21/105; G03G 21/12
USPC ..... 399/35, 358, 360
See application file for complete search history.

(56) References Cited

U.S. PATENT DOCUMENTS 7,657,211 B2 * 2/2010 Kawai ..... 399/358
8,270,891 B2 * 9/2012 Ogashiwa ..... 399/360

FOREIGN PATENT DOCUMENTS

JP 11-272142 A 10/1999
JP 2002-139971 A 5/2002
JP 2002-196644 A 7/2002

* cited by examiner

*Primary Examiner* — William J Royer
(74) *Attorney, Agent, or Firm* — Fitzpatrick, Cella, Harper & Scinto

(57) ABSTRACT

An image forming apparatus includes a first feeding path configured to feed toner collected from an image forming station, a collection container detachably mountable to the image forming apparatus and configured to accommodate the collected toner fed through the first feeding path, and a shutter unit including a second feeding path movably connected with the first feeding path and capable of connecting with the collection container. A shutter is configured to open and close a connecting portion between the second feeding path and the collection container by sliding in a direction crossing with the second feeding path in response to mounting and demounting of the collection container.

12 Claims, 11 Drawing Sheets

(a)

(b)

(c)

(a)

(b)

(a)

(b)

(c)

(a)

(b)

IMAGE FORMING APPARATUS HAVING TONER COLLECTION

FIELD OF THE INVENTION AND RELATED ART

The present invention relates to an image forming apparatus in which toner collected from an image forming station is accumulated in a collection container provided at a predetermined position in a casing, more particularly, an image forming apparatus in which a shutter is provided in a connecting portion between a collected toner feeding path and the collection container.

An image forming apparatus in which a toner image formed in the image forming station is transferred onto a sheet and is fixed by heat on the sheet is widely used. The image forming apparatus is equipped with a collection container for collecting and accumulating untransferred toner or the like produced in the process of forming the toner image in the image forming station. When the collection container becomes full with the collected toner or the like, it is replaced by a new empty collection container.

Recently, with the increase of productivity of the image forming apparatus, there is a tendency that the amount of the generation amount of the collected toner per unit time, and in order to reduce the frequency of the replacement of the collection container, the capacity of the collection container increases.

Japanese Laid-open Patent Application 2002-139971 discloses an image forming apparatus comprising a collection container provided inside a casing.

When the material of the collection container is resin material, which is blow-molded, there is a possibility that variation in the contraction during the blow molding and/or height variation due to the thermal expansion may result. In addition, there is a further possibility that a size in the height direction of the collection container may vary due to the dimensional accuracy of part and/or part mounting accuracy. For these reasons, connection between the collection container and the feeding path in the main assembly side may be improper, and then, the toner may leak out.

SUMMARY OF THE INVENTION

Accordingly, it is a principal object of the present invention to provide an image forming apparatus in which even when the height position of the collection container varies, the leakage of the toner through the connecting portion between the collection container and the main assembly can be suppressed.

According to a first aspect of the present invention, there is provided an image forming apparatus comprising a first feeding path configured to feed toner collected from an image forming station; a collection container detachably mountable to said image forming apparatus and configured to accommodate the collected toner fed through said first feeding path; and a shutter unit including a second feeding path movably connected with said first feeding path and capable of connecting with said collection container, and a shutter configured to open and close a connecting portion between said second feeding path and said collection container by sliding in a direction crossing with said second feeding path in response to mounting and demounting of said collection container.

A shutter unit for opening and closing a connecting portion between a collection container detachably mountable to a main assembly of an image forming apparatus and the main assembly, the main assembly including a first feeding path, said shutter unit comprising a second feeding path movable relative to the first feeding path and movable relative to said collection container; and a shutter configured to open and close the connecting portion between said second feeding path and said collection container by sliding in a direction crossing with said second feeding path in response to mounting and demounting of said collection container.

Further features of the present invention will become apparent from the following description of exemplary embodiments (with reference to the attached drawings).

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described in detail referring to the accompanying drawings.

(Image Forming Apparatus)

Figure 1:
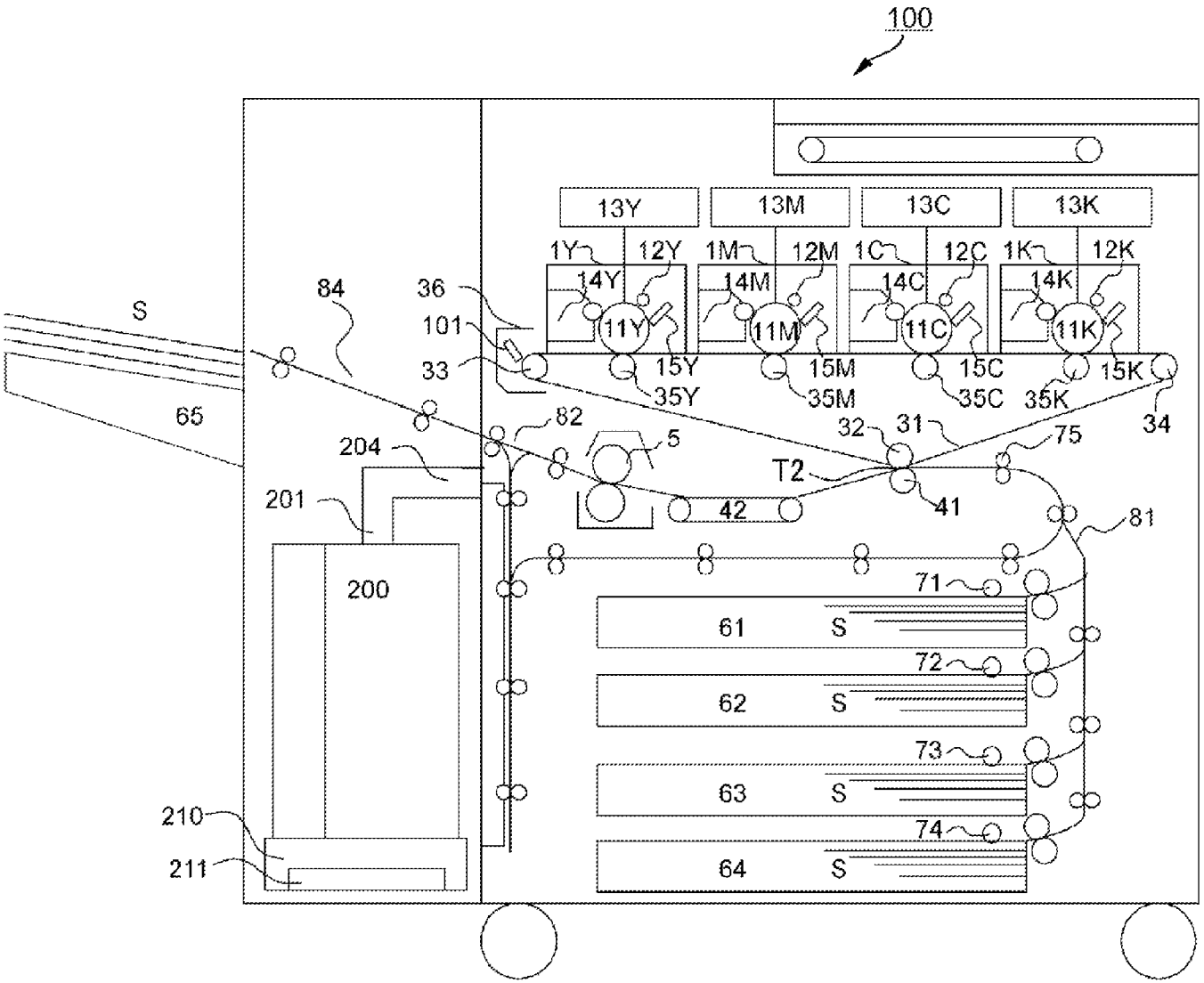
FIG. 1 is an illustration of a structure of an image forming apparatus.

FIG. 1 is an illustration of a structure of an image forming apparatus. As shown in FIG. 1, an image forming apparatus 100 is a full color printer of a tandem type and intermediary transfer type in which yellow, magenta, cyan and black image forming stations 1Y 1M, 1C and 1K are provided along an intermediary transfer belt 31.

In the image forming station 1Y, a yellow toner image is formed on a photosensitive drum 11Y, and is primary-transferred onto the intermediary transfer belt 31. In the image forming station 1M, a magenta toner image is formed on a photosensitive drum 11M, and is primary-transferred onto the intermediary transfer belt 31. In the image forming stations 1C, 1K, a cyan toner image and a black toner image are formed on photosensitive drums 11C and 11K, respectively, and the images are transferred onto the intermediary transfer belt 31.

A sheet (recording material) S is picked up one by one from a cassette 61 (or cassettes 62, 63 and 64), by roller 71 (or rollers 72, 73 and 74), fed to path 81, and stopped by registration rollers 75. The registration rollers 75 feed the sheet S toward a secondary transfer portion T2 in timed relation with the toner image on the intermediary transfer belt 31. The sheet S now having the secondary-transferred four color toner images by the secondary transfer portion T2 is fed to fixing device 5 via rollers 42, where it is subjected to heat pressing, by which the image is fixed, and then, the sheet S is discharged along path 82 and 84 to a discharging tray 65.

(Image Forming Station)

As shown in FIG. 1, the image forming stations 1Y, 1M, 1C, 1K are substantially the same except for the color of the toner (yellow, magenta, cyan and black) in developing devices 14Y, 14M, 14C, 14K. In the following, the description will be made as to the yellow image forming station 1Y, and the descriptions of the image forming stations 1M, 1C, 1K are omitted for simplicity.

Around the photosensitive drum 11Y (11M, 11C and 11K) in the image forming station 1Y (1M, 1C and 1K), there are provided a charging roller 12Y (12M, 12C and 12K), an exposure device 13Y (13M, 13C and 13K), developing device 14Y (14M, 14C and 14K), a transfer roller 35Y (35M, 35C and 35K), and a drum cleaning device 15Y (15M, 15C and 15K). The photosensitive drum 11Y is provided with a photosensitive layer on the outer peripheral surface thereof, and is rotated counterclockwisely in FIG. 1.

The charging roller 12Y charges a surface of the photosensitive drum 11Y to a negative dark portion potential VD. The exposure device 13Y projects a laser beam ON/OFF modulated on the basis of an image signal expanded in a scanning line on the other surface of the photosensitive drum 11Y, so that the potential of the exposed portion is lowered to a light portion potential VL to form an electrostatic image on the surface of the photosensitive drum 11Y in accordance with the image.

The developing device 14Y stirs the developer containing toner and carrier particles to electrostatically charge the toner to a negative polarity and the carrier to a positive polarity, and thereafter, the developer is carried on a developing sleeve in a chain-erected state to develop the electrostatic image on the photosensitive drum 11Y into a toner image.

The transfer roller 35Y is urged to the inner side surface of the intermediary transfer belt 31 to provide a toner image transfer portion between the photosensitive drum 11Y and the intermediary transfer belt 31. By the transfer roller 35Y supplied with a positive DC voltage, the toner image carried on the photosensitive drum 11Y is transferred onto the intermediary transfer belt 31.

The intermediary transfer belt 31 is stretched around a tension roller 33, a driving roller 34, a secondary-transfer inside roller 32 and is given by the driving roller 34 to rotate in the clockwise direction in FIG. 1. A secondary transfer roller 41 is contacted to the intermediary transfer belt 31 supported by the secondary-transfer inside roller 32 to provide the secondary transfer portion T2.

(Collection of Developer)

Figure 2:
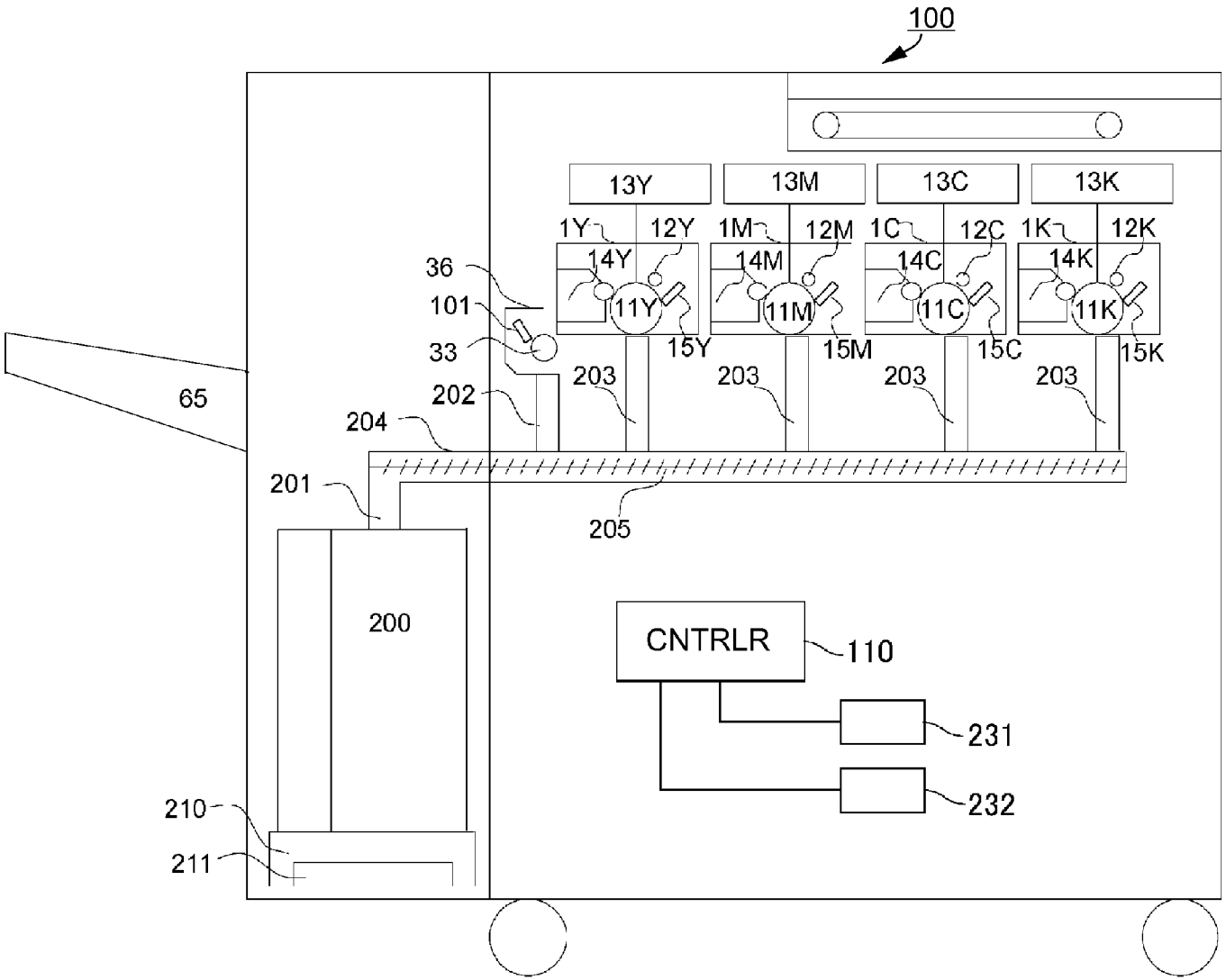
FIG. 2 is an illustration of a collection system of the image forming apparatus.
Figure 3:
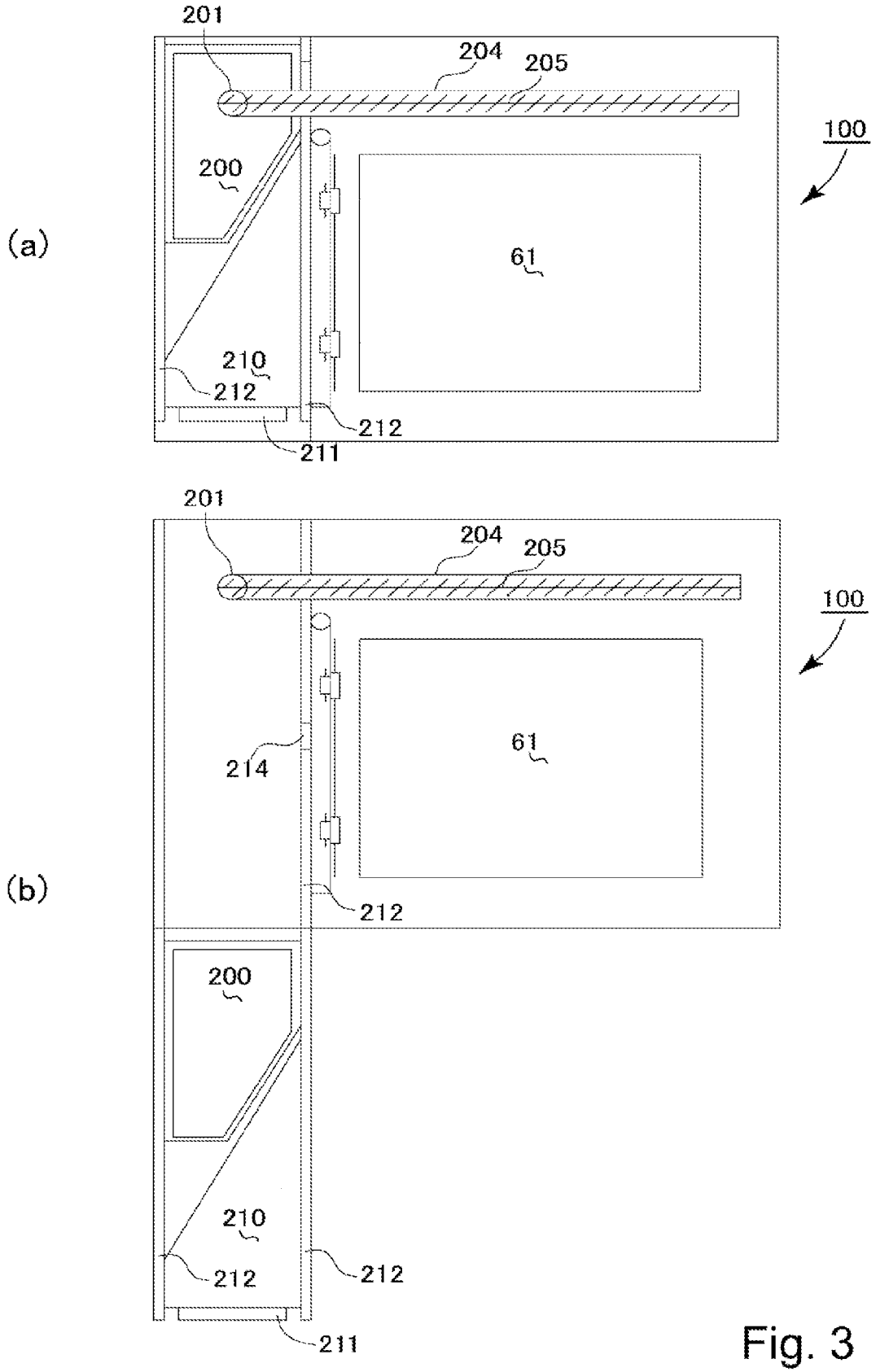
FIG. 3 is a top plan view of a developer collection system of the image forming apparatus.

FIG. 2 is an illustration of a developer collection system of the image forming apparatus 100. FIG. 3 is a top plan view of the developer collection system of the image forming apparatus 100. In FIG. 3, (*a*) shows the state during the image forming operation, and (*b*) shows the state when a collected toner container 200 is exchanged.

As shown in FIG. 2, with the image forming operation, untransferred toner is deposited on the photosensitive drum 11Y. The untransferred toner is scraped off by a cleaning blade of the drum cleaning device 15Y, and is fed by a longitudinal pipe 203 provided in a rear side of the casing by a feeding screw (unshown).

When the two component developer is stirred in the developing device 14Y for a long time, the charging property gradually deteriorates, and therefore, a predetermined ratio of the two component developer is taken out of the developing device 14Y periodically. In order to compensate for the toner concerned with the image formation, the developing device 14Y is supplied with a supply developer containing 10% carrier particles. The developer circulating in the developing device 14Y overflows little by little at a rate corresponding to the consumption amount of the toner with the image formation, and the overflowed developer is fed to the longitudinal pipe 203 as a deteriorated developer.

With the image formation, the untransferred toner is deposited on the intermediary transfer belt 31. The untransferred toner is scraped off by a cleaning blade 101 of a belt cleaning device 36 and is fed to a longitudinal pipe 202 disposed in a rear side of the casing by the feeding screw (unshown).

The untransferred toner and the deteriorated developer fed to longitudinal pipes 202, 203 fall therein into a main collection pipe 204. As shown in part (*a*) of FIG. 3, the untransferred toner and the deteriorated developer in the main collection pipe 204 is fed to a discharging pipe 201 by a collection screw 205, and then they fall in the discharging pipe 201 to accumulate in the collected toner container 200.

If the collected toner container 200 is provided for each of the image forming stations 1Y, 1M, 1C, 1K and the belt cleaning device 36, the full-state detection and/or the exchanging operation for the collected toner containers 200 are cumbersome. Therefore, the image forming apparatus 100 collects the collected toner and the collected developer in the common collected toner container 200. The collected toner container 200 is a consumption part to be exchanged with an empty collected toner container 200 when it becomes full of the collected toner. Recently, the capacity of the collected toner container 200 has become large as a result of image quality improvement and operation speed-up of the image forming apparatus 100.

(Drawing Structure of Collected Toner Container)

Figure 4:
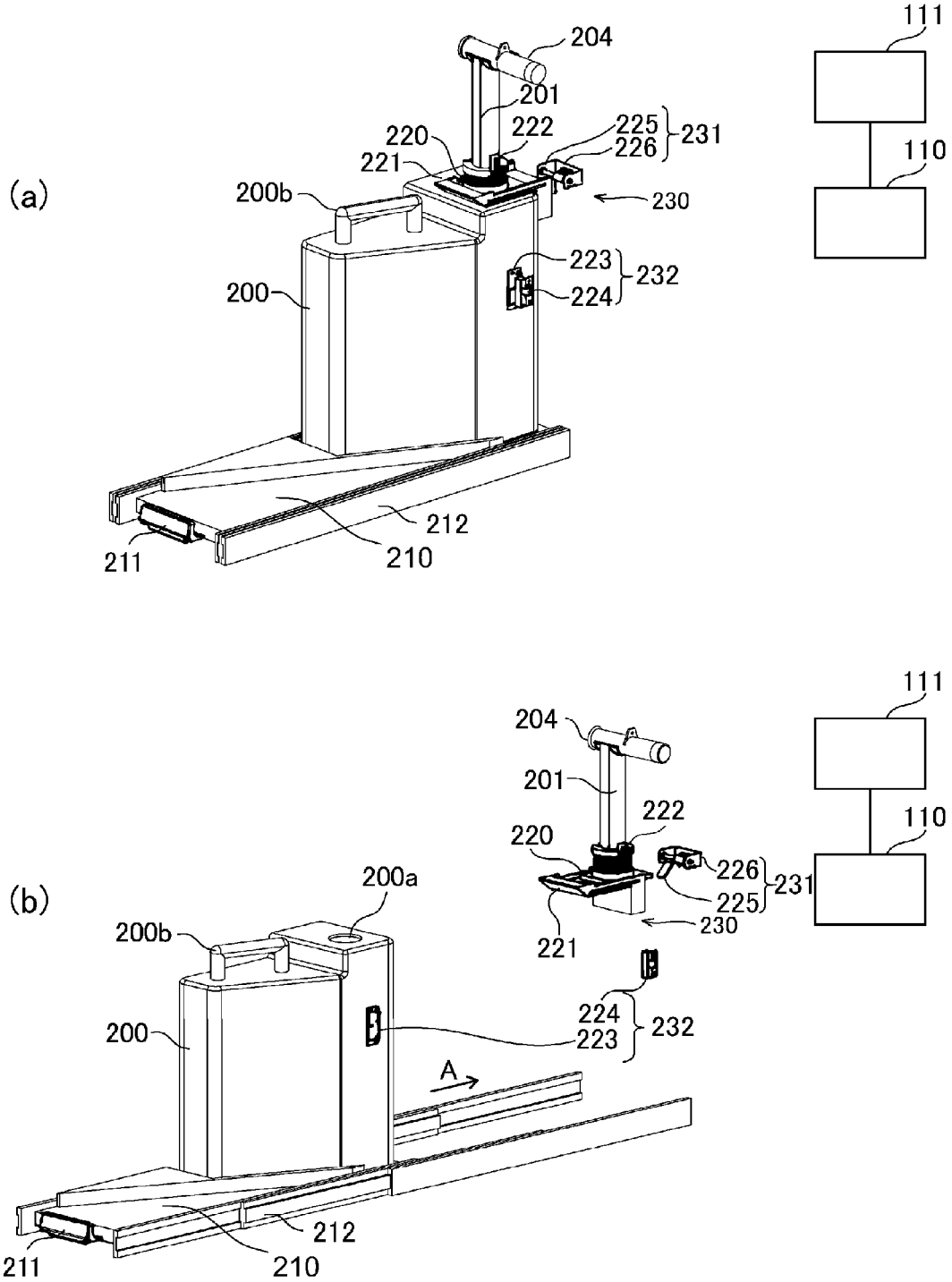
FIG. 4 is an illustration of a guiding mechanism of a collected toner container.

FIG. 4 is an illustration of a guiding mechanism of the collected toner container 200. In FIG. 4, (*a*) shows the state during the image forming operation, and (*b*) shows the state when the collected toner container 200 is exchanged.

As shown in part (*a*) of FIG. 4, the discharging pipe 201 which is an example of the feeding path is effective to feed the toner collected in the image forming station 1Y to a predetermined position in the casing. The collected toner container 200 is connectable to the casing at a predetermined position in the casing, slide rails 212 are capable of moving the collected toner container 200 between the predetermined position and the position where the collected toner container 200 can be taken out of the main assembly of the image forming apparatus 100.

A three-stage drawer type slide rail 212 is mounted to the casing of the image forming apparatus 100, and a collected toner tray 210 is fixed on the first (leading) rail of the slide rail 212. The collected toner container 200 is placed on the collected toner tray 210 and is inserted into the casing of the image forming apparatus 100.

As shown in part (*b*) of FIG. 4, a tray grip 211 is fixed to the front side of the collected toner tray 210. Upon the exchange of the collected toner container 200, the collected toner container 200 is taken out using the tray grip, by which the collected toner tray 210 carrying the collected toner container 200 is moved to the front side along the slide rail 212.

The collected toner container 200 is provided with a container grip 200*b* on the upper front side. As shown in part (*b*) of FIG. 3, in the state that the collected toner tray 210 is drawn out to such an extent that the collected toner container 200 outside beyond the front side of the image forming apparatus 100, the used collected toner container 200 is taken out using the container grip 200*b* and is exchanged with a new empty collected toner container 200.

(Collected Toner Container)

The collected toner container 200 is made of polypropylene (PP) resin material, and is produced by blow molding. The size of the collected toner container 200 is 300 mm (depth)×200 mm×(width)×height 400 mm (height) (outer shape). A linear expansion coefficient of the polypropylene (PP) is 11×10^−5, and therefore, when the ambient temperature changes by 20 degree C., the collected toner container 200 having the height of 400 mm expounds by 0.9 mm in the direction of the height. Because of the variation of the contraction due to the blow molding, which is approximately 1 mm, the collected toner container 200 having the height of 400 mm may vary in the direction of the height by 2 mm in total. When other factors such as dimensional accuracies of the peaks and the accuracy of the mounting are taken into account, 3 mm at the minimum of the variation of the size of the collected toner container 200 in the direction of the height will be taken into consideration.

Under the circumstances, in Embodiment 1, a stroke amount of 6 mm is assured for the movement of an opening and closing shutter unit 230 during the mounting and demounting and exchange of the collected toner container 200, so that assured connection is accomplished between the collected toner container 200 and the discharging pipe 201.

(Opening and Closing Shutter Unit)

Figure 5:
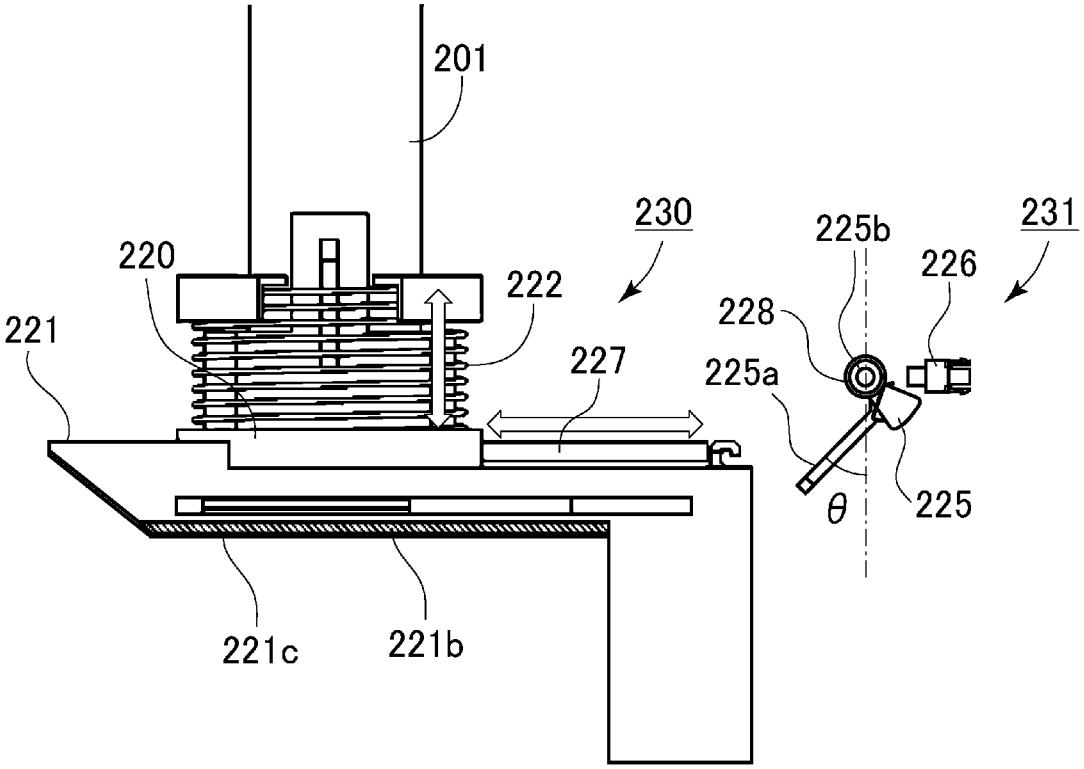
FIG. 5 is an illustration of a structure of an opening and closing shutter unit.

FIG. 5 is an illustration of a structure of the opening and closing shutter unit 230.

As shown in part (*a*) of FIG. 4, the opening and closing shutter unit 230 is provided at a downstream end of the discharging pipe 201. Upon the mounting of collected toner container 200, when collected toner tray 210 is inserted in the mounting direction, the opening and closing shutter unit 230 is pushed by the collected toner container 200 to open.

As shown in part (*b*) of FIG. 4, with the movement of the collected toner container 200 guided by the slide rail 212 in the direction of the arrow A, the opening and closing shutter unit 230 is connected to an opening 200*a* in the upper surface of the collected toner container 200. Upon the removal of the collected toner container 200, when the collected toner tray 210 is drawn out, the opening and closing shutter unit 230 is released from the collected toner container 200, so that the opening and closing shutter unit 230 automatically closes.

A shutter member 221 moves in the direction of the height to close-contact the upper surface of the collected toner container 200. The shutter member 221 opens the discharging pipe 201 with the operation of the movement of the collected toner container 200 to the predetermined position by the slide rail 212, and seals the discharging pipe 201 with the operation of removal of the collected toner container 200 from the predetermined position.

As shown in FIG. 5, the shutter member 221 is provided at the downstream end of the discharging pipe 201 and is urged by a shutter urging spring 227, which is an example of the urging portion toward the collected toner container 200 in the direction perpendicular to the mounting direction.

A second discharging pipe 220 is movable vertically along the discharging pipe 201. A pipe urging spring 222 presses the second discharging pipe 220 downwardly to close-contact it to the opening (200*a*, part (*b*) of FIG. 4) of the collected toner container 200.

The shutter member 221 is mounted to the bottom end portion of the second discharging pipe 220 so as to be movable in the front and rear direction, and seals the second discharging pipe 220 in the state that it is in the front side position (left side in FIG. 5). The shutter urging spring 227 urges the shutter member 221 toward the front side.

A sponge sheet 221*b* is pasted on a lower surface of the shutter member 221 for the purpose of assured sealing of the shutter member 221. The lower surface of the sponge sheet 221*b* is provided with a sliding sheet 221*c* pasted thereon to accomplish a sufficient slidability of the shutter member 221.

(Operation of Opening and Closing Shutter Unit)

Figure 6:
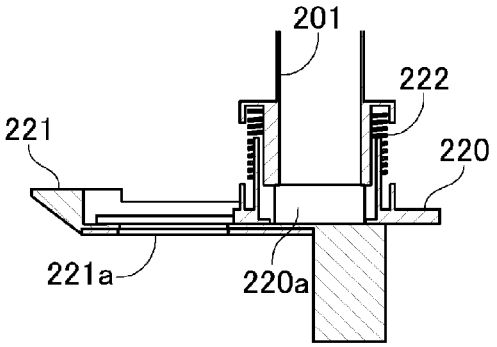
FIG. 6 is an illustration of an operation of the opening and closing shutter unit.
Figure 6:
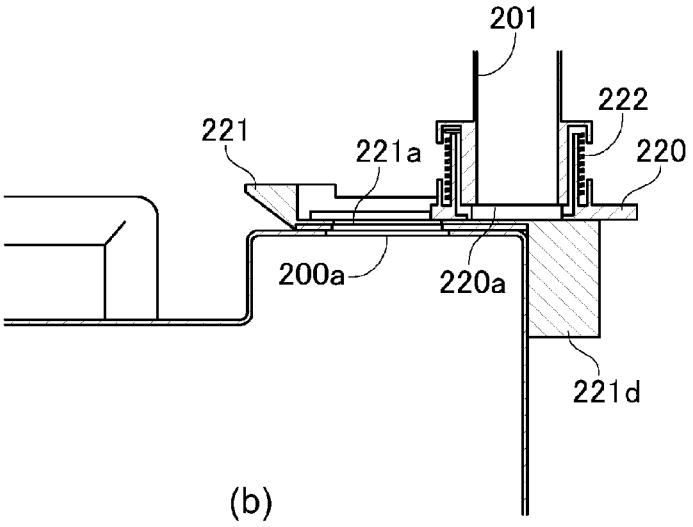
Figure 6:
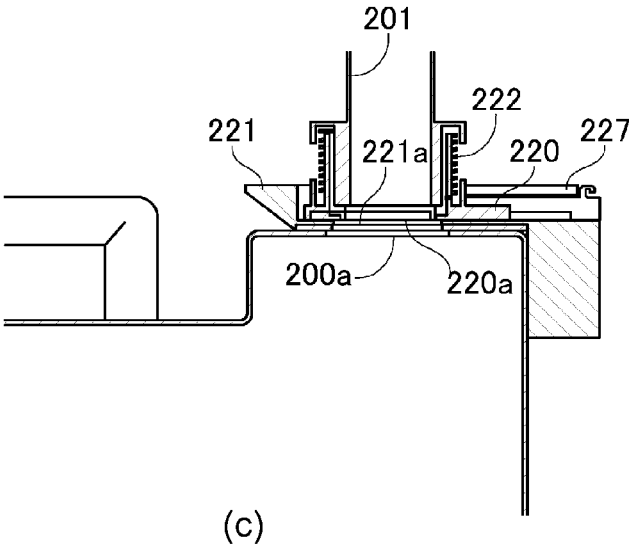

FIG. 6 is an illustration of an operation of the opening and closing shutter unit 230. In FIG. 6, (*a*) shows an un-connected state, (*b*) shows a connection process state, and (*c*) shows a connected state.

As shown in part (*a*) of FIG. 6, when the collected toner container 200 is not yet connected, the shutter member 221 is in the front side (left side in FIG. 6) to seal the opening 220*a* of the second discharging pipe 220.

As shown in part (*b*) of FIG. 6, when the collected toner container 200 is moved toward the rear side (right side in FIG. 6), the shutter member 221 and the second discharging pipe 220 are pushed up against the pressing of the pipe urging spring 222 along the inclined surface of the shutter member 221. When the collected toner container 200 is advanced to the position where it is abutted to an abutment portion 221*d*, the opening 221*a* of the shutter member 221 and opening 200*a* of collected toner container 200 are brought into fluid communication with each other.

Thereafter, as shown in part (*c*) of FIG. 6, when the collected toner container 200 is moved further toward the rear side (right side in FIG. 6), the shutter member 221 is moved toward the rear side (right side in FIG. 6) against the force of the shutter urging spring 227. When the opening 221*a* of the shutter member 221 and the opening 220*a* of the second discharging pipe 220 are in fluid communication with each other, the inside spaces of the discharging pipe 201 and the collected toner container 200 are communicated, so that the collected toner can fall into the collected toner container 200.

(Opening and Closing Sensor Unit)

Figure 7:
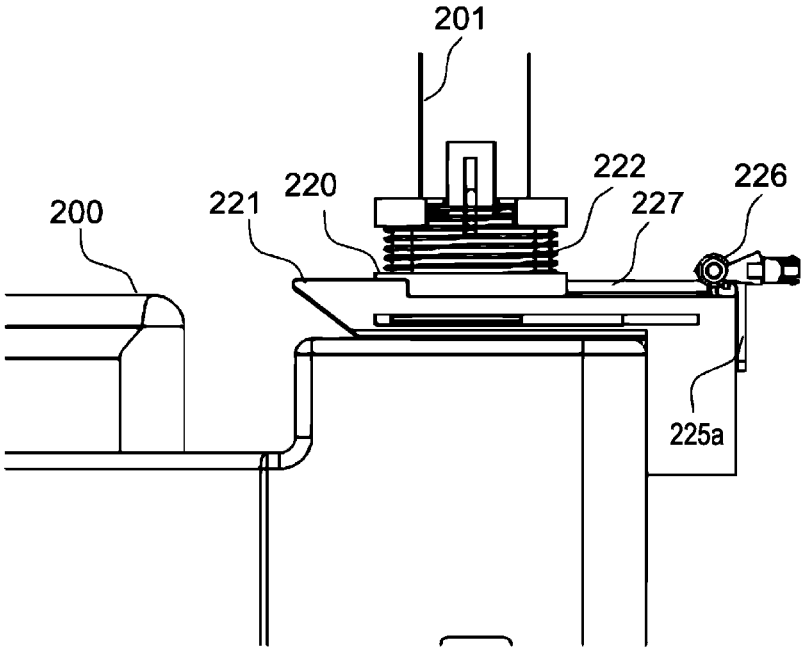
FIG. 7 is an illustration of an operation of an opening and closing sensor.
Figure 7:
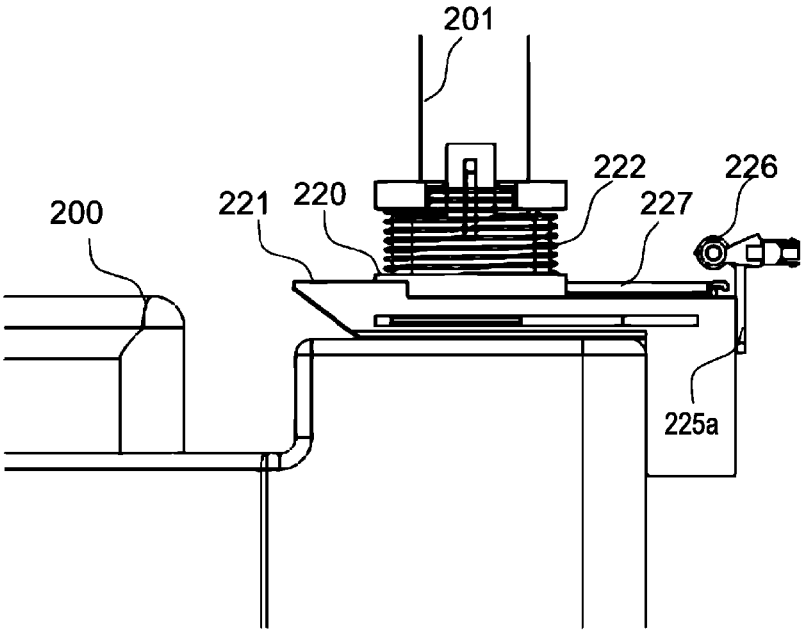

FIG. 7 is an illustration of an operation of an opening and closing sensor unit 231.

As shown in part (*a*) of FIG. 4, even when the collected toner container 200 is correctly positioned on the collected toner tray 210, the opening and closing shutter unit 230 does not always permit the communication between the inside spaces of the discharging pipe 201 and the collected toner container 200. When, for example, the image forming operation is carried out in the state that the opening and closing shutter unit 230 is insufficiently open, that is opposite polarity that the toner leaks from the discharging pipe 201 into the casing of the image forming apparatus 100. Therefore, in Embodiment 1, the opening and closing sensor unit 231 is provided to discriminate the fully open state of the opening and closing shutter unit 230, and after the discrimination, the image forming operation is carried out.

As shown in part (*b*) of FIG. 4, for the opening and closing sensor unit 231, an arm rotatable in a plane including a guiding direction of the slide rail 212 is contacted to the shutter member 221 to detect the movement of the shutter member 221. The arm stands by with a first angle as measured from a direction perpendicular to the guiding direction of the slide rail 212, and when it is rotated to a second angle by contact to the shutter member 221, it outputs a signal indicative of opening of the discharging pipe 201. The first angle is larger than the second angle.

As shown in FIG. 5, the opening and closing sensor unit 231 detects the shutter member 221 to output a signal indicative of the opening and sealing of the discharging pipe 201. The opening and closing sensor unit 231 supports a sensor flag 225 including an abutment surface 225*a* so as to be rotatable about a rotational shaft 225*b*. A photosensor 226 is rendered ON/OFF at predetermined rotation angles of the sensor flag 225. A sensor spring 228 urges the sensor flag 225 in the clockwise rotational moving direction in FIG. 5.

As shown in part (*b*) of FIG. 4, the abutment surface of the sensor flag 225 (225*a*, FIG. 5) stands by at the rotational position inclined by an angle θ from the vertical surface toward the front side. When the shutter member 221 is closed, the abutment surface (225*a*, FIG. 5) of the sensor flag 225 inclines toward the front side, and the signal value of the photosensor 226 is Low. When the signal value of the photosensor 226 is Low, the shutter member 221 is closed.

In the process of the collected toner tray 210 moving in the direction indicated by the arrow A, the abutment surface (225*a*, FIG. 5) of the sensor flag 225 contacts to the shutter member 221 and is pushed in the clockwise direction in FIG. 4. When the shutter member 221 is opened to the extent that the sensor flag 225 is completely away from the photosensor 226, the output signal value of the photosensor 226 changes from the Low to High. The image forming apparatus 100 is designed such that the angle θ between the abutment surface 225*a* of the sensor flag 225 and the vertical surface is 0° in the state that the collected toner container 200 is at the predetermined position in the casing. In addition, the abutment surface 225*a* is perpendicular when the mounting of the collected toner container 200 is completed.

Heights of the collected toner containers 200 which have been blow molded are not constant. However, even when the collected toner container 200 is relatively taller as shown in part (*a*) of FIG. 7 or even when the collected toner container 200 is relatively less taller as shown in part (*b*) of FIG. 7, the photosensor 226 becomes rendered on a position where the abutment surface 225*a* becomes perpendicular.

When it is discriminated that the shutter member 221 is open as a result of the change of the output signal value of the photosensor 226 from the Low state to the High state, the state of opening of the shutter member 221 is constant respective of the height of the collected toner container 200. Therefore, the state of opening of the shutter member 221 can be accurately detected by the photosensor 226. Even if the height of the collected toner container 200 is not constant, the opening state of the shutter member 221 at the time when the output signal value of the photosensor 226 changes from the Low state to the High state can be evenly acquired.

(Fullness Detecting Sensor)

Figure 8:
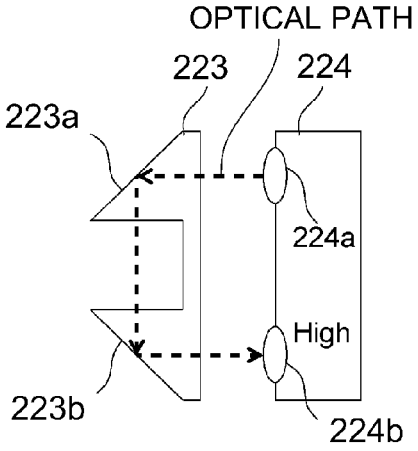
FIG. 8 is an illustration of full-state detection of the collected toner container.
Figure 8:
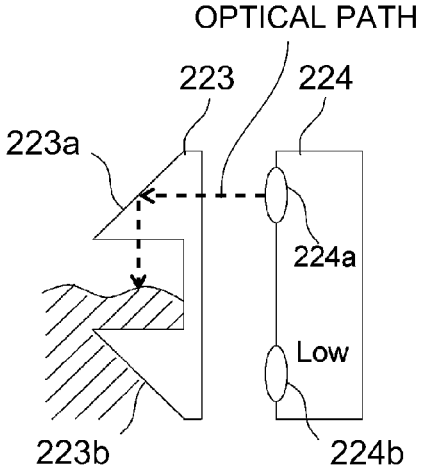
Figure 8:
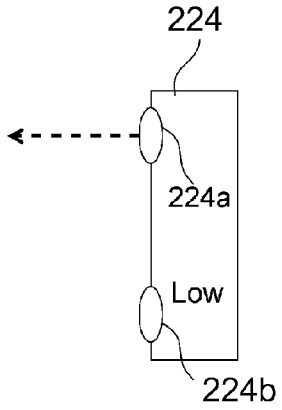

FIG. 8 is an illustration of full-state detection of the collected toner container 200. In FIG. 8, (*a*) shows an empty state, (*b*) shows a full state, and (*c*) shows the state in which the collected toner container is dismounted. As shown in part (*a*) of FIG. 4, a fullness detecting sensor 232 includes a photosensor 224 mounted on the casing of the image forming apparatus 100, and a prism 223 mounted on the collected toner container 200.

The prism 223 which is an example of an optical path member constitutes, in the collected toner container 200, a detecting light path which is closed by the toner which is accumulated beyond a predetermined level. The fullness detecting sensor 232 which is an example of an optical path detecting portion detects the light which has been incident on the prism 223 and passes through the prism 223, when the collected toner container 200 is in the predetermined position.

As shown in part (*a*) of FIG. 8, the light emitted from a light emission surface 224*a* of the photosensor 224 is folded by reflecting surfaces 223*a* and 223*b* of the prism 223 and is incident on a receipt surface 224*b* of the photosensor 224, in response to which the photosensor 224 produces a High signal.

As shown in part (*b*) of FIG. 8, when the collected toner container 200 is filled with the collected toner, the collected toner enters a groove provided between the reflecting surfaces 223*a* and 223*b* and blocks the light, in response to which the photosensor 224 produces a Low signal.

As shown in part (*c*) of FIG. 8, when the collected toner container 200 is not set, no light returns from the prism 223, and therefore, the photosensor 224 produces the Low signal.

(Control According to Embodiment 1)

Figure 9:
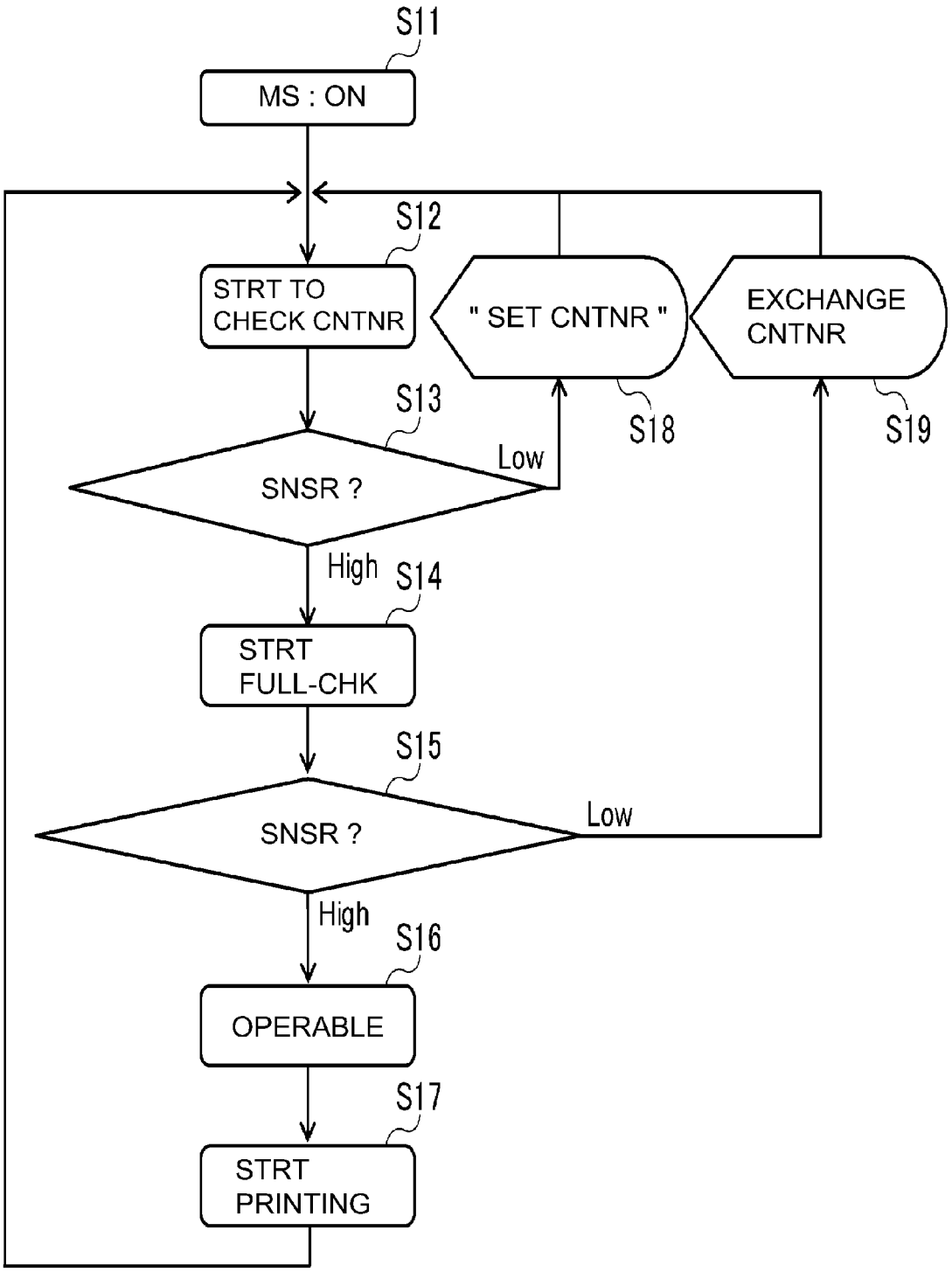
FIG. 9 is a flow chart of a control according to Embodiment 1.

FIG. 9 is a flow chart of a control according to Embodiment 1

As shown in part (*a*) of FIG. 4, a controller 110 controls the image forming station 1Y on the basis of an output of the opening and closing sensor unit 231 so that when the discharging pipe 201 is open, the image forming operation is executed, and when the discharging pipe 201 is sealed, the image forming operation is not executed. The controller 110 controls image forming station 1Y so that when the discharging pipe 201 is open and the detecting light is detected, the image forming operation is executed, and when the discharging pipe 201 is sealed and when the detecting light is not detected, the image forming operation is not executed. More specifically, the printing operation is not started until both of the signal value of the opening and closing sensor unit 231 and the signal value of the fullness detecting sensor 232 become High.

An operation panel 111 which is an example of the display portion effects display indicative of non-connection of the collected toner container 200 when the discharging pipe 201 is sealed and when the detecting light is not detected. When the discharging pipe 201 is open and the detecting light is not detected, the full-state of the collected toner container 200 is displayed.

As shown in FIG. 9, when the voltage source of the image forming apparatus 100 is switched on (S11), the controller 110 starts presence or absence detection of the collected toner container 200 on the basis of the detection signal of the opening and closing sensor unit 231 (S12). When the output of the photosensor 226 of the opening and closing sensor unit 231 is High ((S13, High), controller 110 discriminates that the shutter member 221 is open, and starts full-state detection for the collected toner container (S14). When the output of the photosensor 224 of the fullness detecting sensor 232 is High (S15, High), the controller 110 discriminates that the printing operation is possible (S16), and starts the printing operation (S17).

When the output of the photosensor 226 of the opening and closing sensor unit 231 is Low (S13, Low), the controller 110 discriminates that no collected toner container 200 is set as yet and requires mounting of the collected toner container 200 (S18). When the output of the photosensor 224 of the fullness detecting sensor 232 is Low (S15, Low), the controller 110 discriminates that the collected toner container 200 is full and requires exchange of the collected toner container 200 (S19).

As described in the foregoing, in Embodiment 1, the collected toner container 200, which is an example of a collection container, is detachably mounted to the main assembly of the image forming apparatus 100 to accommodate the collected toner discharged from the collected toner feeding path. The shutter member 221, which is an example of a shutter, opens and closes the connecting portion between the feeding path and the collected toner container 200 in response to the mounting and demounting of the collected toner container 200. The opening and closing sensor unit 231, which is an example of a detecting portion, detects the opening and closing of the shutter member 221. The fullness detecting sensor 232, which is an example of a container detecting portion, is capable of detecting the mounting of the collected toner container 200 in the mounting position. The controller 110 permits the image forming operation in response to the detection results of the fullness detecting sensor 232 and the opening and closing sensor unit 231.

In Embodiment 1, using such controls, the printing operation can be redundantly interlocked. In case that the collected toner container 200 is set at a position other than the predetermined position in the casing of the image forming apparatus 100, the printing operation cannot be started if at least one of the outputs of the opening and closing sensor unit 231 and the fullness detecting sensor 232 is detected. Even if the shutter member 221 is opened normally, the printing operation is not started if there is a positional deviation between the prism 223 and the photosensor 224.

(Comparison with a Comparison Example)

The image forming apparatus disclosed in Japanese Laid-open Patent Application 2002-139971 is taken as comparison example 1. In comparison example 1, two fullness detecting sensors are provided for a toner bottle to detect the near-fullness and fullness of the toner bottle. Generally, a collected toner container is manufactured using blow molding because it is capable of molding a hollow configuration at low cost, but the collected toner container manufactured by blow molding is not constant in the size thereof because of the variations of the temperature and humidity. In the case that the setting surface of the collected toner container and the connecting portion are spaced apart, the positional accuracy of the connecting portion may not be enough with the result of connection defect, due to the change of the size of the collected toner container.

In Embodiment 1, the shutter member 221 is movable in the mounting and demounting direction of the collected toner container 200 relative to the main assembly and in the vertical direction, and therefore, the variation of the height of the collected toner container 200 or the deformation thereof can be accommodated. In addition, the presence or absence of the collected toner container 200 is detected by the opening/closing of the shutter member 221 using the opening and closing sensor unit 231, and therefore, the connection between the collected toner container 200 and the discharging pipe 201 can be correctly discriminated.

Effects of the Embodiments

Figure 10:
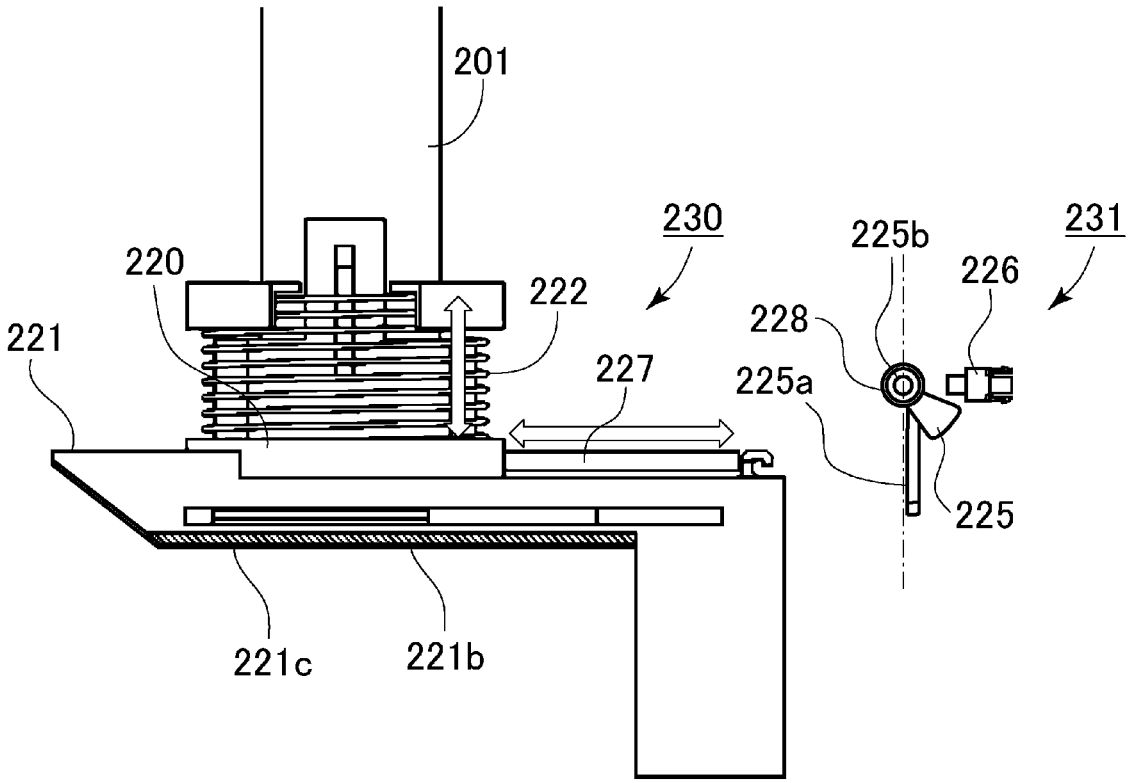
FIG. 10 is an illustration of a structure of an opening and closing shutter unit according to comparison example 2.
Figure 11:
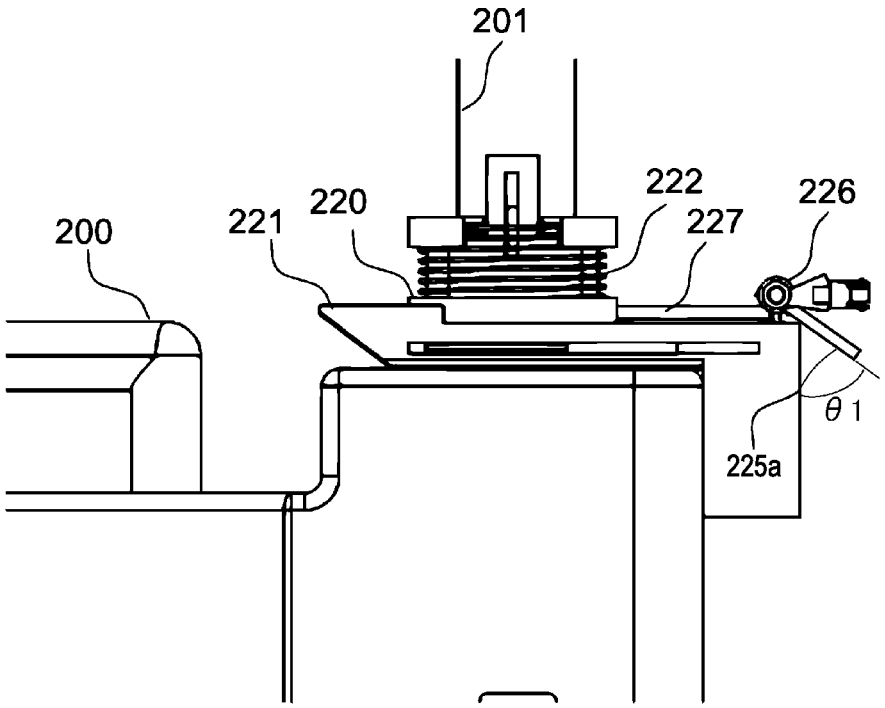
FIG. 11 is an illustration of an operation of an opening and closing sensor in comparison example 2.
Figure 11:
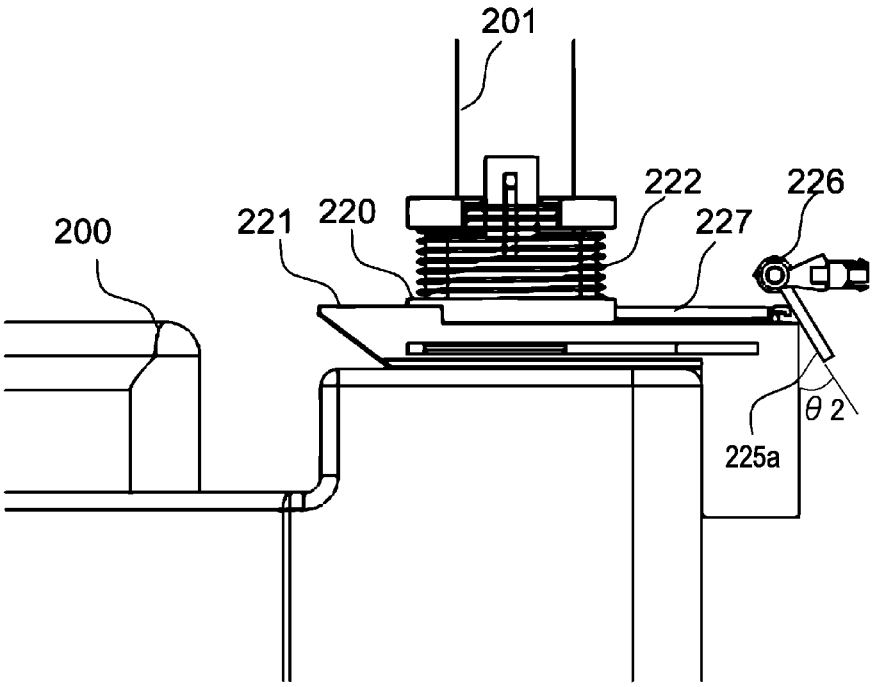

FIG. 10 is an illustration of a structure of an opening and closing shutter unit according to comparison example 2. FIG. 11 is an illustration of an operation of an opening and closing sensor unit in comparison example 2.

According to Embodiment 1, the collected toner container 200 is manufactured by blow molding, and therefore, the collected toner container 200 can be produced at low cost. The setting surface of the collected toner container 200 is at the lower surface of the collected toner container 200, and therefore, the size of the collected toner container 200 can be made large without a complicated structure for the setting surface. A large collected toner container 200 is usable in a copy shop or POD field, meeting the recent demand for image quality improvement, speed-up and downsizing.

According to Embodiment 1, the opening 200*a* is provided in the upper surface of the collected toner container 200, and therefore, the feeding of the collected toner from the collected toner feeding pipe into the collected toner container 200 can be accomplished only by gravity. By this, the toner can be accumulated evenly in the collected toner container 200. It is unnecessary to provide a leveling means such as a screw or a paddle or the like in the collection container, and therefore, the mechanism of the image forming apparatus 100 can be simplified. The collected toner container 200 can be easily exchanged by anyone, and it can be assuredly connected with the discharging pipe 201. The shutter member 221 is urged toward the closing position by the shutter urging spring 227, and therefore, the toner leakage discharging from the inside of the collection container can be avoided.

As shown in FIG. 5, in Embodiment 1, the opening and closing sensor unit 231 is provided with a sensor flag 225 including an abutment surface 225*a* for abutment to the shutter member 221 and the detection surface. And, in Embodiment 1, the sensor flag 225 at the time when the shutter member 221 is closed, it is inclined by θ relative to the vertical line.

As shown in FIG. 7, in Embodiment 1, when the shutter member 221 is open, the shutter member 221 abuts to the abutment surface 225*a* of the sensor flag 225, and at this time, the angle of the sensor flag 225 is substantially vertical. Therefore, the difference of the angle of the sensor flag 225 between when the height of the shutter member 221 as shown in part (*a*) of FIG. 7 and when the height position of the shutter member 221 is low as shown in part (*b*) of FIG. 7. For this reason, even if the height of the toner bottle is not constant, the repeatability of the relation between the opening state of the shutter member 221 and the angular position of the sensor flag 225 is high.

On the contrary, in comparison example 2 as shown in FIG. 10, the angular position of the sensor flag 225 at the time when the shutter member 221 is closed is substantially vertical (θ is nearly equal to zero). For this reason, as shown in part (*a*) of FIG. 11, when the height position of the shutter member 221 is high, the angle of the sensor flag 225 relative to the vertical line at the time when the shutter member 221 is open is θ1. As shown in part (*a*) of FIG. 11, when the height position of the shutter member 221 is low, the angle of the sensor flag 225 relative to the vertical line in the state that the shutter member 221 is open is θ2.

Therefore, when the height of the toner bottle changes, the reproducibility of the relationship between the opening state of the shutter member 221 and the angular position of the sensor flag 225 is deteriorated. In comparison example 2, when the shutter member 221 is open, the angle of the sensor flag 225 relative to the vertical line formed by the shutter member 221 abutting to the abutment surface 225*a* of the sensor flag 225 is different depending on the height of the shutter member 221.

In Embodiment 1, the fullness detecting sensor 232 for detecting the amount of the collected toner in the collection container is provided. When the fullness discrimination is, the fullness detecting sensor 232 produces the output which is the same as when no collection container is provided in the main assembly. Because the outputs upon the fullness of the collection container and in the absence of the collection container are the same, and therefore, even in case of malfunction of the opening and closing sensor 231, the feeding of the collected toner in the absence of the collected toner container 12 can be avoided.

In Embodiment 1, the fullness detecting sensor 232 is constituted by light emission surface 224*a* and the receipt surface 224*b* of the main assembly and the prism 223 of the collected toner container 200, and therefore, the full-state detection of the collected toner container 200 is assured.

Because of this, the structure is simple using the light emission surface 224*a* and receipt surface 224*b* of the photosensor and the prism 223.

According to the image forming apparatus of the present invention, the image forming operation can be prohibited in the absence of the collection container and also in the case that the shutter portion is not open because of the connection defect between the feeding path and the collection container. Accordingly, the image forming operation is permitted only when the collected toner in the collection container can be properly and assuredly received.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 220922/2013 filed Oct. 24, 2013, which is hereby incorporated by reference.

What is claimed is:

1. An image forming apparatus comprising:

a first feeding path configured to feed toner collected from an image forming station;

a collection container detachably mountable to said image forming apparatus and configured to accommodate the collected toner fed through said first feeding path; and a shutter unit including a second feeding path movably connected with said first feeding path and capable of connecting with said collection container, and a shutter configured to open and close a connecting portion between said second feeding path and said collection container by sliding in a direction crossing with said second feeding path in response to mounting and demounting of said collection container.

2. An apparatus according to claim 1, further comprising a movable guiding portion for guiding said collection container between a mounting position where said collection container is mounted and a position where said collection container is capable of being taken out to an outside of said image forming apparatus, wherein said shutter is capable of being opened by being contacted by said collection container advancing toward the mounting position while being guided by said guiding portion.

3. An apparatus according to claim 2, further comprising a detecting portion configured to detect opening and closing of said shutter, wherein said detecting portion contacts an arm which is rotatable in a plane including a guiding direction of said guiding portion, to said shutter, so that movement of said shutter is detected, and wherein said arm stands by with a first rotation angle as measured from a direction perpendicular to the guiding direction in the plane, and when rotated to a second rotation angle by the contact to the shutter, the opening of said shutter is detected, and wherein the first rotation angle is larger than the second rotation angle.

4. An apparatus according to claim 1, wherein said shutter is movable in a vertical line direction to be closely contacted to an upper surface of said collection container placed in a mounting position, in response to mounting and demounting of said collection container.

5. An apparatus according to claim 1, wherein said collection container is made of resin material and is made using blow molding.

6. A shutter unit for opening and closing a connecting portion between a collection container detachably mountable to a main assembly of an image forming apparatus and the main assembly, the main assembly including a first feeding path, said shutter unit comprising:

a second feeding path movable relative to the first feeding path and movable relative to the collection container; and a shutter configured to open and close the connecting portion between said second feeding path and the collection container by sliding in a direction crossing with said second feeding path in response to mounting and demounting of the collection container.

7. An image forming apparatus comprising:

a first feeding pipe configured to feed toner collected from an image forming station;

a collection container detachably mountable to said image forming apparatus and configured to accommodate the collected toner fed through said first feeding pipe; and a shutter unit movable in an axial direction of said first feeding pipe and connected with said first feeding pipe;

said shutter unit including, a second feeding pipe provided so as to overlap with said first feeding pipe in the axial direction and configured to feed the collected toner from said first feeding pipe to said collection container;

said second feeding pipe being provided with a discharge opening for discharging the collected toner toward said collection container; and a shutter configured to open and close said discharge opening by sliding in a direction crossing with the axial direction in response to the mounting and demounting of said collection container.

8. An apparatus according to claim 7, further comprising a guiding portion for guiding the mounting and demounting of said collection container in the direction crossing the axial direction.

9. An apparatus according to claim 8, further comprising a detecting portion configured to detect opening and closing of said shutter, wherein said detecting portion contacts an arm which is rotatable in a plane, including a guiding direction of said guiding portion, to said shutter, so that movement of said shutter is detected, and wherein said arm stands in a first rotation angle as measured from a direction perpendicular to the guiding direction in the plane, and when rotated to a second rotation angle by contact with the shutter, the opening of said shutter is detected, and wherein the first rotation angle is larger than the second rotation angle.

10. An apparatus according to claim 7, further comprising a contact portion configured to contact and move said collection container to effect the sliding of said shutter.

11. An apparatus according to claim 7, further comprising an urging portion configured to urge said shutter unit toward a portion where said collection container is mounted.

12. An apparatus according to claim 11, wherein said urging portion urges said shutter unit through said second feeding pipe.

* * * * *